US006470867B2

(12) United States Patent
Akiwa et al.

(10) Patent No.: US 6,470,867 B2
(45) Date of Patent: Oct. 29, 2002

(54) MULTI CYLINDER INTERNAL COMBUSTION ENGINE COMPRISING A CYLINDER HEAD INTERNALLY DEFINING EXHAUST PASSAGES

(75) Inventors: Toshihiro Akiwa, Wako (JP); Masayuki Takahashi, Wako (JP); Hiroshi Sakamoto, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/934,606

(22) Filed: Aug. 23, 2001

(65) Prior Publication Data

US 2002/0023436 A1 Feb. 28, 2002

(30) Foreign Application Priority Data

Aug. 25, 2000 (JP) ..... 2000-256000

(51) Int. Cl.[7] ..... F01N 3/035

(52) U.S. Cl. ..... 123/672; 123/691; 123/193.5; 60/276

(58) Field of Search ..... 123/672, 691, 123/692, 494, 193.5, 673; 60/276, 302, 304, 306

(56) References Cited

U.S. PATENT DOCUMENTS 4,325,346 A * 4/1982 Yokoyama ..... 123/184.39
4,993,227 A 2/1991 Nagura et al.
5,095,704 A 3/1992 Nagura et al.
6,055,970 A * 5/2000 Takahashi ..... 123/672
6,062,020 A * 5/2000 Blanchet et al. ..... 60/302
6,065,442 A * 5/2000 Motose et al. ..... 123/294
6,295,956 B1 * 10/2001 Kato et al. ..... 123/193.5

FOREIGN PATENT DOCUMENTS

JP 5-44499 11/1993
JP 2709815 10/1997

* cited by examiner

*Primary Examiner*—Erick Solis
(74) *Attorney, Agent, or Firm*—Armstrong, Westerman & Hattori, LLP

(57) ABSTRACT

In a multi cylinder internal combustion engine comprising a cylinder head internally defining exhaust passages extending from a plurality of combustion chambers defined in part by the cylinder head, the exhaust passages converging into a converging area also internally defined in the cylinder head, an oxygen sensor for detecting an oxygen concentration in exhaust gas is passed into the converging area substantially in parallel with a cylinder axial line. Thus, the oxygen sensor can be mounted relatively close to the combustion chamber while permitting the sensor to be uniformly exposed to the exhaust gas from the combustion chambers of an entire cylinder bank. Therefore, the oxygen sensor can be activated relatively quickly substantially without any warm-up, and can measure the oxygen concentration of the overall exhaust gas.

15 Claims, 4 Drawing Sheets

MULTI CYLINDER INTERNAL COMBUSTION ENGINE COMPRISING A CYLINDER HEAD INTERNALLY DEFINING EXHAUST PASSAGES

TECHNICAL FIELD

The present invention relates to a multi cylinder internal combustion engine comprising a cylinder head internally defining exhaust passages.

BACKGROUND OF THE INVENTION

It is known to form exhaust passages and a converging area into which the exhaust passages converge internally in a cylinder head as shown in Japanese patent No. 2709815. Japanese UM publication No. 5-44499 discloses engines in which an oxygen sensor for detecting an oxygen concentration is placed in an exhaust manifold and in an exhaust pipe downstream to the exhaust manifold.

As an oxygen sensor is incapable of operating while the engine is still cold, it is preferable to mount the oxygen sensor as close to a combustion chamber as possible. However, if it is provided upstream of the exhaust manifold, it is exposed only to the exhaust gas produced from one of the cylinders, and incapable of giving the oxygen concentration of the overall exhaust gas. It is conceivable to provide an oxygen sensor for each combustion chamber, but it increases the cost and weight of the engine.

BRIEF SUMMARY OF THE INVENTION

In view of such problems of the prior art, a primary object of the present invention is to provide a multi cylinder internal combustion engine having a compact exhaust manifold arrangement internally defined in a cylinder head.

A second object of the present invention is to provide a multi cylinder internal combustion engine which allows an oxygen sensor to be mounted relatively close to the combustion chamber while permitting the sensor to be uniformly exposed to the exhaust gas from the combustion chambers of an entire cylinder bank.

A third object of the present invention is to provide a multi cylinder internal combustion engine which can activate an oxygen sensor with a minimum warm up time period.

A fourth object of the present invention is to provide a multi cylinder internal combustion engine which can protect an oxygen sensor from an excessive temperature rise.

A fifth object of the present invention is to provide a multi cylinder internal combustion engine which provides a favorable mounting position for an oxygen sensor while providing a favorable cylinder head arrangement.

A sixth object of the present invention is to provide a multi cylinder internal combustion engine which provides a favorable mounting position for an oxygen sensor so as to prevent damages to the oxygen sensor by being hit by an external object.

According to the present invention, these and other objects can be accomplished by providing a multi cylinder internal combustion engine comprising a cylinder head internally defining exhaust passages extending from a plurality of combustion chambers defined in part by the cylinder head, the exhaust passages converging into a converging area also internally defined in the cylinder head, wherein: an oxygen sensor for detecting an oxygen concentration in exhaust gas is passed into the converging area substantially in parallel with a cylinder axial line.

Thus, the oxygen sensor can be mounted relatively close to the combustion chamber while permitting the sensor to be uniformly exposed to the exhaust gas from the combustion chambers of an entire cylinder bank. Therefore, the oxygen sensor can be activated relatively quickly substantially without any warm-up, and can measure the oxygen concentration of the overall exhaust gas. By passing the oxygen sensor in parallel with a cylinder axial line, the sensor is protected from the heat of the converging area. In particular, by passing the sensor downwardly into the converging area from above, the assembly work can be simplified.

In particular, if the converging area and the exhaust passages are defined at least in part by an exhaust passage wall extending laterally from the cylinder head defining an arched profile in a plane perpendicular to a cylinder axial line, and an oxygen sensor for detecting an oxygen concentration in exhaust gas is passed into the converging area, a particularly compact arrangement can be achieved. Also, the mounting position for the oxygen sensor can be gained in a compact manner without requiring any special arrangement.

According to a preferred embodiment of the present invention for a favorable mounting position for the oxygen sensor, an exhaust outlet is defined adjacent to the converging area, and a hole for receiving the oxygen sensor is formed in a part of the cylinder head interposed between a pair of bosses provided adjacent to the exhaust outlet for supporting threaded bolts for joining an exhaust system component to the exhaust outlet.

Once the oxygen sensor has been warmed up to a desired level, it is then desirable to prevent it from an excessively high temperature. To this end, a water jacket may be defined in the cylinder head so as to extend to an adjacent part of the oxygen sensor.

Preferably, the exhaust system component consists of a catalytic converter, and an outer profile of the oxygen sensor is more inwardly located than an outer profile of the catalytic converter. Thus, the damages to the oxygen sensor by being hit by an external object during transportation and assembly work can be avoided. In the case of a V-type engine, preferably, a dimension between outer ends of oxygen sensors for the respective cylinder banks being smaller than a dimension between outer ends of the catalytic converters.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
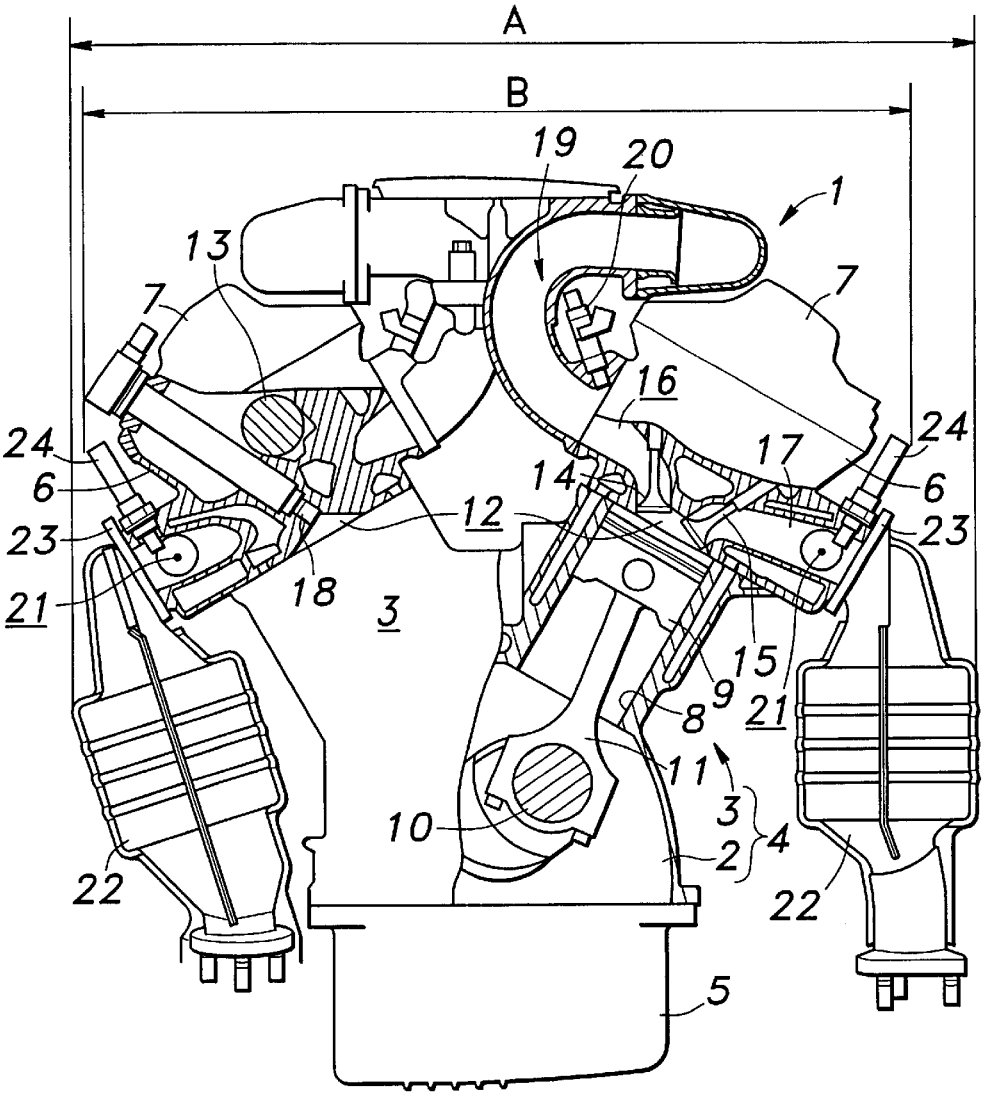
FIG. 1 is a partly broken away front view of a V-type six-cylinder engine embodying the present invention.

FIG. 1 generally shows a V-type six-cylinder engine embodying the present invention. This engine 1 comprises a cylinder block 4 defining a crankcase 2 and a pair of cylinder banks 3 arranged in the shape of letter-V, an oil pan 5 attached to the lower surface of the cylinder block 4, a pair of cylinder heads 6 attached to the respective upper ends of the cylinder banks 3, and a head cover 7 attached to the upper surface of each cylinder head 6.

Each cylinder hank 3 includes three cylinders 8 arranged in a single row, and a piston 9 is slidably received in each cylinder 8. Each piston 9 is connected to a crankshaft 10 rotatably supported by the crankcase 2 via a connecting rod 11.

The cylinder head 6 of each cylinder bank 3 defines three combustion chambers 12 corresponding to the three cylinders 8, and each combustion chamber 12 is provided with a pair of intake ports each provided with an intake valve 14 and a pair of exhaust ports each provided with an exhaust valve 15. The intake valves 14 and exhaust valves 15 are actuated by a camshaft 13 which is coupled to the crankshaft 10. A part of the cylinder head 6 corresponding to each combustion chamber 12 is fitted with a spark plug 18 having an electrode extending into the combustion chamber 12.

Between the opposing sides of the cylinder banks 3 is provided an intake manifold 19 which is communicated with the intake ports via intake passages 16 extending inwardly out of the combustion chamber 12. Fuel injection valves 20 are provided in the intake manifold 19 to inject fuel into the individual intake passages 16.

Exhaust passages 17 extend within the corresponding cylinder heads 6 outwardly from the exhaust ports of the combustion chambers 12, and converge at a converging area 21 defined in each cylinder head 6. Each converging area 21 directly communicates with an exhaust outlet 26 opening out centrally on a side of the cylinder head 6. The exhaust outlet 26 is surrounded by a relatively thick-walled annular part whose outer surface defines a mounting surface 27 for a flange 23 of a catalytic converter 22. Therefore, the cylinder head 6 internally defines an exhaust manifold including the exhaust passages 17 and converging area 21. An oxygen sensor 24 is passed through an upper wall of the cylinder head 6 located above the converging area 21. This oxygen sensor 24 is provided with a detecting part which is located centrally in the converging area 21 so as to evenly contact the flow of the exhaust gas from the combustion chambers 12.

The distance A between the outer ends of the oxygen sensors 24 provided in the corresponding cylinder banks 3 is smaller than the distance B between the outer ends of the catalytic converters 22 of the corresponding cylinder banks 3 (A>B). In other words, an outer profile of the oxygen sensor is more inwardly located than an outer profile of the catalytic converter. As a result, the outer most part of the lateral profile of the engine is defined by the catalytic converters 22 so that the oxygen sensors 24 are protected from damages that could be caused by hitting other objects during transportation and assembling work even without taking any protective measures.

Figure 2:
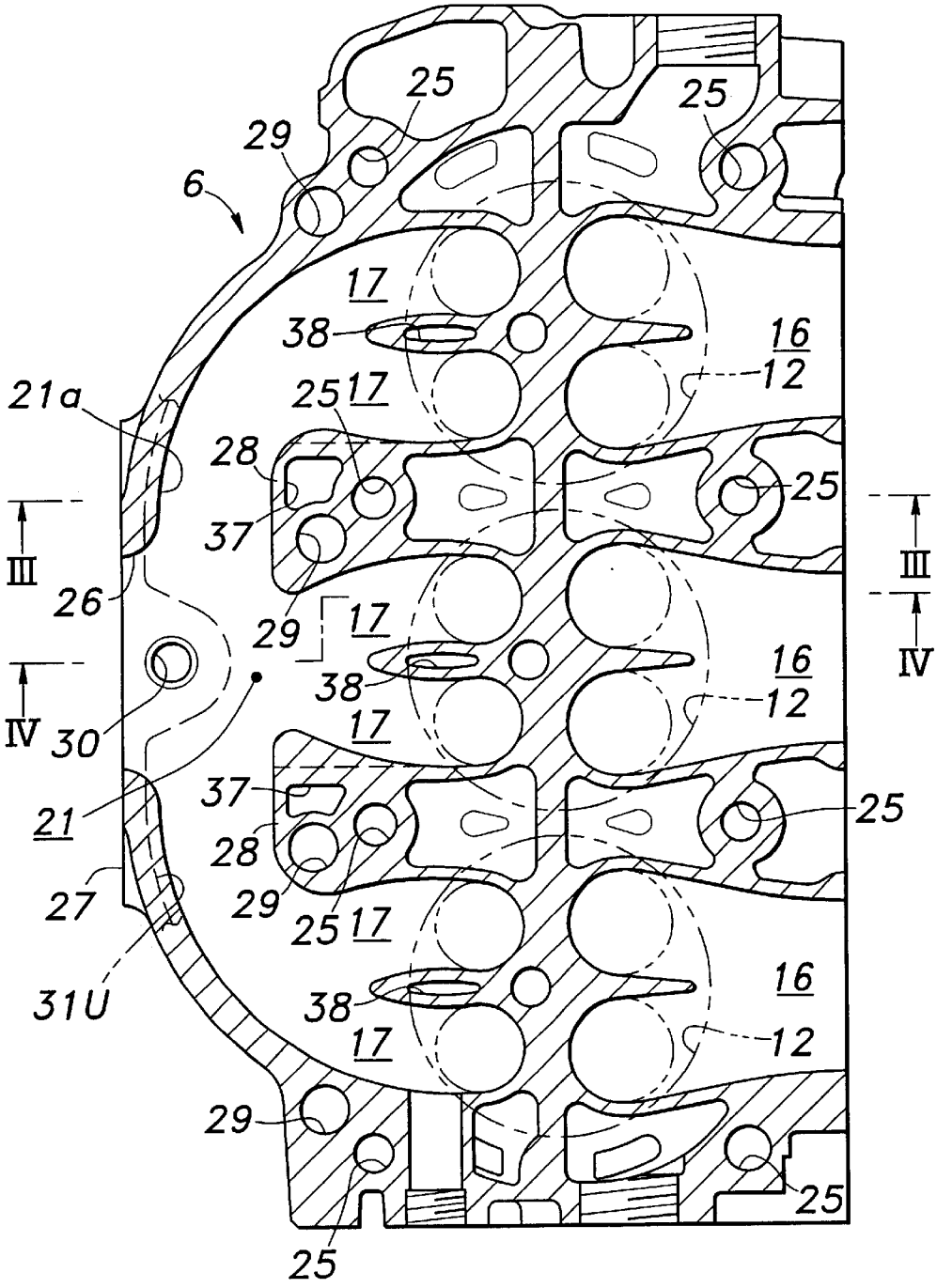
FIG. 2 is a sectional bottom view of one of the cylinder heads of the engine shown in FIG. 1 taken along a plane passing through the central lines of the exhaust passages 17.

The cylinder head 6 is described in more detail in the following with reference to FIG. 2 which shows a section of the cylinder head 6 of one of the cylinder banks (for instance, the right cylinder bank) taken along a plane passing through the central lines of the exhaust passages 17.

Each intake passage 16 bifurcates into two sections which directly connect to the intake ports for each combustion chamber 12, and the inlet end of the intake passage 16 opens out on the intake side of the cylinder head 6. On the intake side of the cylinder head 6, four vertical walls are internally defined inside the cylinder head between the adjacent combustion chambers and in the both ends of the cylinder bank 3, and a head bolt opening 25 is drilled in each of these vertical walls to pass a corresponding one of four head bolts that are used for joining the cylinder head 6 to the cylinder block 4.

The exhaust ports for each cylinder are separated from each other by a vertical wall, and merge into the corresponding exhaust passage 17. The exhaust passage 17 for the central combustion chamber 12 extends straight to the common exhaust outlet 26 via the converging area 21. The exhaust side of the cylinder head 6 is defined by an exhaust passage wall 33 defining an arched profile in a plane perpendicular to a cylinder axial line. The exhaust passage 17 extending from each of the combustion chambers on an axial end of the cylinder hank 3 extends along the inner side of the corresponding part of the exhaust passage wall 33. Numeral 21*a* denotes a downstream end of the exhaust passage 17 extending from each cylinder on an axial end of the cylinder bank which opens out into the converging area. A pair of vertical walls 28 are internally formed on the exhaust side of the cylinder head 6 so as to separate the exhaust passages from one another. In other words, the three exhaust passages 16 on each cylinder bank are defined substantially by the vertical walls 28 and exhaust passage wall 33.

Each of these vertical walls 28 is formed with a head bolt receiving hole 25 and an oil return passage 29 for communicating the interior of the head cover 7 with the interior of the crankcase 2. Each axial end portion of the arched exhaust passage wall 33 is formed with a head bolt receiving hole 25 and an oil return passage 29. These head bolt receiving holes 25 and oil return passages 29 are also formed by drilling.

Because all of the oil return passages 29 are formed adjacent to the exhaust passages 17, the lubricating oil can be quickly warmed up after starting the engine, and the time period required for the engine warm-up can be reduced. A mounting hole 30 for the oxygen sensor 24 is formed centrally in the converging area 21.

Figure 3:
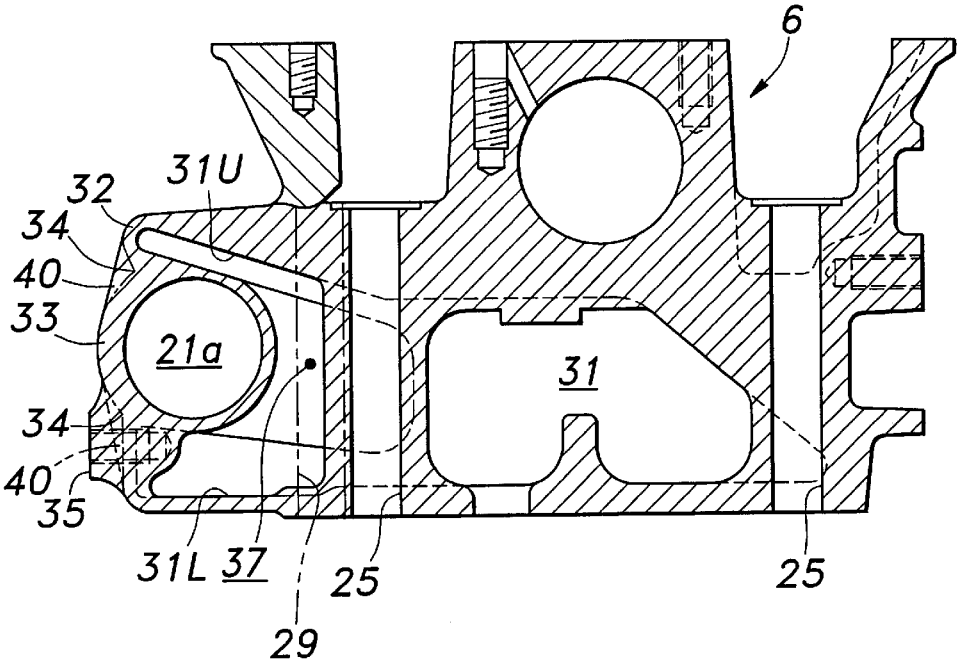
FIG. 3 is a sectional view taken along line III—III of FIG. 2.
Figure 4:
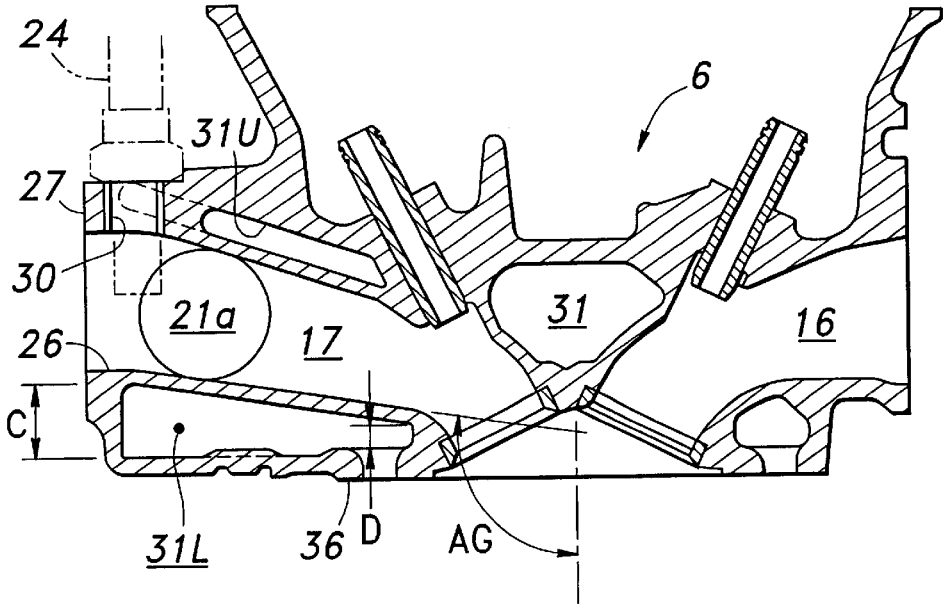
FIG. 4 is a sectional view taken along line IV—IV of FIG. 2.

Referring to FIGS. 3 and 4, the cylinder head 6 is provided with a water jacket 31 which extends above and below the exhaust passages 17 as well as above each combustion chamber 12. The outer periphery of the upper and lower water jackets 31U and 31L generally extends along the arched contour of the laterally outer wall or the exhaust passage wall 33 of the cylinder head 6, but does not quite laterally extend so far as the arched exhaust passage wall 33 of the cylinder head 6. In this embodiment, the exhaust passages 17 extend along an upwardly slanted plane as seen in the direction of the exhaust gas flow.

If outer end walls 32 of the upper and lower water jackets 31 and the part of the exhaust passage wall 33 corresponding to the exhaust converging area 21 were given with a uniform wall thickness, there would be a recess 34 (as indicated by the imaginary lines in FIG. 3) along each of the upper and lower ends of the exhaust passage wall 33. However, according to this embodiment, each of the outer end walls 32 of the upper and lower water jackets 31 and the exhaust passage wall 33 are connected by connecting walls 40, and the outer profile of the exhaust side of the cylinder head 6 generally presents a smooth surface devoid of such recesses. The connecting walls 40 increase the effective wall thickness of the outer peripheral part of the cylinder head 6, and can increase both the rigidity and thermal capacity of the converging area 21 without increasing the outer dimensions of the cylinder head 6.

Figure 5:
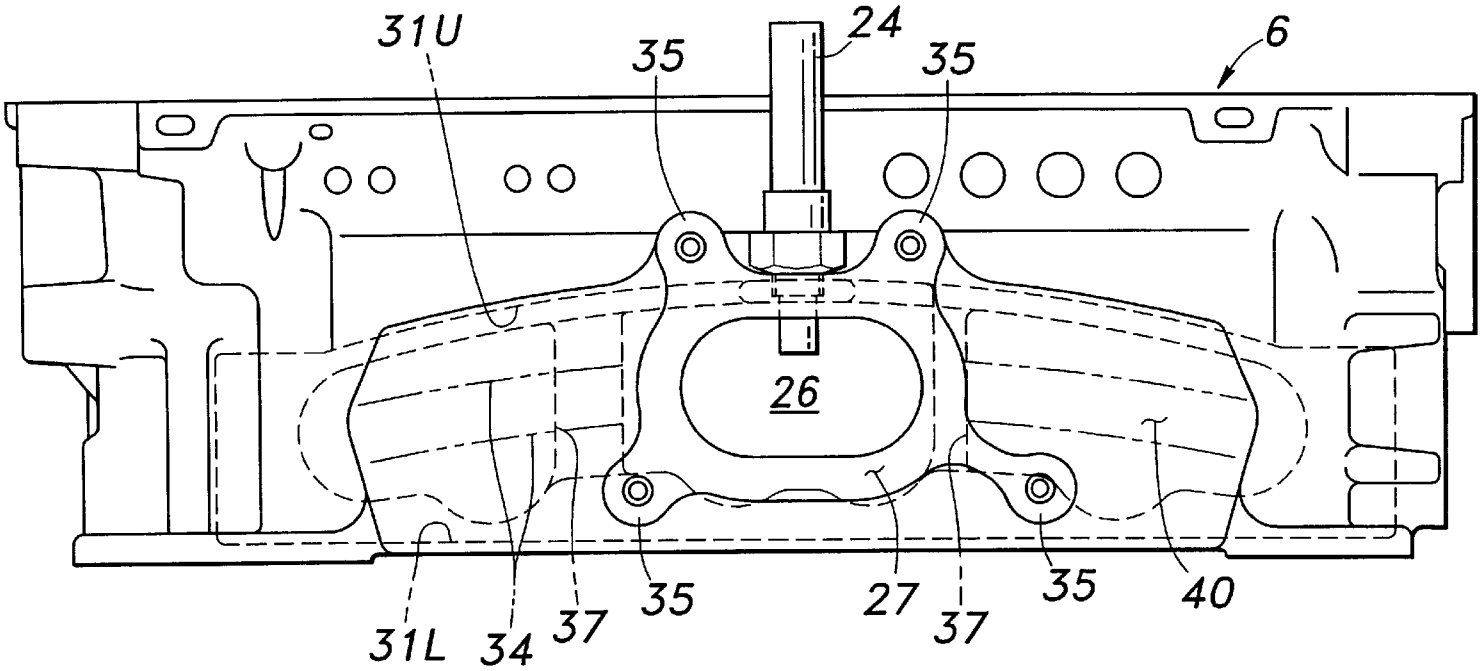
FIG. 5 is a side view of the cylinder head shown in FIG. 2.

As shown in FIG. 5, the connecting walls 40 are integrally connected to the four bosses 35 each formed with a threaded hole for receiving a threaded bolt for securing the catalytic converter 22. The four bosses 35 are in turn integrally connected to the annular thick wall surrounding the exhaust outlet 26. Therefore, the connecting walls 40 in cooperation with the annular thick wall contributes to the increase in the rigidity of the mounting surface 27 for the catalytic converter. Furthermore, the hole 30 for receiving the oxygen sensor 24 is formed between the upper two of the bosses 35, and this allows the oxygen sensor 24 to be mounted without requiring any special provision or increasing the outer dimensions of the converging area 21.

The tangential surface of the bottom of the exhaust passages 17 forms an obtuse angle AG relative to the cylinder axial line as seen from the crankshaft as shown in FIG. 4. The part of the lower water jacket 31L located under the exhaust passages 17 has a lower wall having a constant thickness and extending in parallel with the mating surface 36 of the cylinder head 6 for the cylinder block 4. Therefore, the height of the lower water jacket 31L is greater in the part remote from the combustion chamber 12 than the part adjacent to the combustion chamber 12 (C>D). Also, the lower water jacket 31L located under the exhaust passages 17 has a greater capacity than the upper water jacket 31U located above the exhaust passages 17. The upper and lower water jackets 31U and 31L extend from the central part of the cylinder head 6 to either lateral end at least beyond the downstream end 21*a* at which each exhaust passage 17 extending from the combustion chamber 12 on each axial end merges with the converging area 21.

Therefore, the water jackets, in particular the lower water jacket 31L, are given with a large cooling water capacity in the area corresponding to the outer peripheral part of the converging area 21 which tends to have a high temperature. Therefore, this embodiment allows the efficiency of cooling the exhaust passages 17 to be improved without impairing the compact design of the engine. Also, because the upward slanting of the exhaust passages 17 minimizes the thickness of the upper wall of the converging area, the necessary length of the oxygen sensor can be minimized.

The upper water jacket 31L extends to either side of the oxygen sensor 24 or, in other words, is provided with a semicircular profile on an outer end thereof so as to partly surround the oxygen sensor 24. Therefore, the oxygen sensor 24 is placed close to the combustion chamber so as to permit compact design of the cylinder head, and the excessive heating of the oxygen sensor can be avoided by circulating the cooling water close to the oxygen sensor.

The upper and lower water jackets 31U and 31L are communicated with each other by a communication passage 37 provided in each of the vertical walls 28 formed between adjacent combustion chambers and a communication passage 38 provided in a small vertical wall separating the two exhaust ports in each combustion chamber 12. In each of the vertical walls 28 formed between adjacent combustion chambers, the oil return passage 29 extends immediately next to the communication passage 37 so that the excessive rise in the temperature of the lubricating oil can be avoided, and the quality of the lubricating oil can be maintained over an extended period of time. Also, the oil return passage 29 and communication passage 37 would not cause any increase in the axial dimension of the cylinder head because they are conveniently formed in the walls 28 formed between adjacent cylinder heads.

When a relatively large water jacket is formed in the cylinder head, there is a need to support the core that is used when casting the cylinder head in a stable manner. In particular, it is desirable to join the core parts defining the upper and lower water jackets by connecting portions having an adequate cross sectional area. In this case, the core parts defining the communication passage between the exhaust ports of each combustion chamber may not provide an adequate rigidity for connecting the core parts defining the upper and lower water jackets 31U and 31L. In this embodiment, the additional communication passages 37 are formed between adjacent combustion chambers, and the core parts defining these communication passages provide an additional support for the integrity of the core. Furthermore, because the upper water jacket 31U is substantially smaller than the lower water jacket 31L, the load on the core parts joining the core parts defining the upper and lower water jackets 31U and 31L is substantially reduced.

Also, when placing the core parts for the exhaust passages between the core parts for the upper and lower water jackets, it is necessary to avoid any interferences between these core parts in the crankshaft axial direction. However, this arrangement allows it to be accomplished without any difficulty.

In the foregoing embodiment, each oxygen sensor was passed vertically downwardly into the converting area to facilitate the assembly work, but it is also possible for the oxygen sensor to be passed vertically upward from below if desired.

Although the present invention has been described in terms of a preferred embodiment thereof, it is obvious to a person skilled in the art that various alterations and modifications are possible without departing from the scope of the present invention which is set forth in the appended claims.

What is claimed is:

1. A multi cylinder internal combustion engine comprising a cylinder head internally defining exhaust passages extending from a plurality of combustion chambers defined in part by said cylinder head, said exhaust passages converging into a converging area also internally defined in said cylinder head, wherein:

an oxygen sensor for detecting an oxygen concentration in exhaust gas is passed into said converging area substantially in parallel with a cylinder axial line.

2. A multi cylinder internal combustion engine according to claim 1, wherein an exhaust outlet is defined adjacent to said converging area, and a hole for receiving said oxygen sensor is formed in a part of said cylinder head interposed between a pair of bosses provided adjacent to said exhaust outlet for supporting threaded bolts for joining an exhaust system component to said exhaust outlet.

3. A multi cylinder internal combustion engine according to claim 2, wherein said engine consists of a V-type engine having a pair of cylinder banks, and said exhaust system component consists of a catalytic converter for each of said cylinder banks, a dimension between outer ends of oxygen sensors for the respective cylinder banks being smaller than a dimension between outer ends of said catalytic converters.

4. A multi cylinder internal combustion engine according to claim 1, wherein said engine consists of a V-type engine having a pair of cylinder banks, and said exhaust system component consists of a catalytic converter for each of said cylinder banks, a dimension between outer ends of oxygen sensors for the respective cylinder banks being smaller than a dimension between outer ends of said catalytic converters.

5. A multi cylinder internal combustion engine according to claim 1, wherein said exhaust system component consists of a catalytic converter, and an outer profile of said oxygen sensor is more inwardly located than an outer profile of said catalytic converter.

6. A multi cylinder internal combustion engine comprising a cylinder head internally defining exhaust passages extending from a plurality of combustion chambers defined in part by said cylinder head, said exhaust passages converging into a converging area also internally defined in said cylinder head, wherein:

said converging area and said exhaust passages are defined at least in part by an exhaust passage wall extending laterally from said cylinder head defining an arched profile in a plane perpendicular to a cylinder axial line, and an oxygen sensor for detecting an oxygen concentration in exhaust gas is passed into said converging area.

7. A multi cylinder internal combustion engine according to claim 6, wherein an exhaust outlet is defined adjacent to said converging area, and a hole for receiving said oxygen sensor is formed in a part of said cylinder head interposed between a pair of bosses provided adjacent to said exhaust outlet for supporting threaded bolts for joining an exhaust system component to said exhaust outlet.

8. A multi cylinder internal combustion engine according to claim 7, wherein said engine consists of a V-type engine having a pair of cylinder banks, and said exhaust system component consists of a catalytic converter for each of said cylinder banks, a dimension between outer ends of oxygen sensors for the respective cylinder banks being smaller than a dimension between outer ends of said catalytic converters.

9. A multi cylinder internal combustion engine according to claim 6, wherein said engine consists of a V-type engine having a pair of cylinder banks, and said exhaust system component consists of a catalytic converter for each of said cylinder banks, a dimension between outer ends of oxygen sensors for the respective cylinder banks being smaller than a dimension between outer ends of said catalytic converters.

10. A multi cylinder internal combustion engine according to claim 6, wherein said exhaust system component consists of a catalytic converter, and an outer profile of said oxygen sensor is more inwardly located than an outer profile of said catalytic converter.

11. A multi cylinder internal combustion engine comprising a cylinder head internally defining exhaust passages extending from a plurality of combustion chambers defined in part by said cylinder head, said exhaust passages converging into a converging area also internally defined in said cylinder head, wherein:

an oxygen sensor for detecting an oxygen concentration in exhaust gas is passed into said converging area, and a water jacket defined in said cylinder head extends to an adjacent part of said oxygen sensor.

12. A multi cylinder internal combustion engine according to claim 11, wherein an exhaust outlet is defined adjacent to said converging area, and a hole for receiving said oxygen sensor is formed in a part of said cylinder head interposed between a pair of bosses provided adjacent to said exhaust outlet for supporting threaded bolts for joining an exhaust system component to said exhaust outlet.

13. A multi cylinder internal combustion engine according to claim 12, wherein said engine consists of a V-type engine having a pair of cylinder banks, and said exhaust system component consists of a catalytic converter for each of said cylinder banks, a dimension between outer ends of oxygen sensors for the respective cylinder banks being smaller than a dimension between outer ends of said catalytic converters.

14. A multi cylinder internal combustion engine according to claim 11, wherein said engine consists of a V-type engine having a pair of cylinder banks, and said exhaust system component consists of a catalytic converter for each of said cylinder banks, a dimension between outer ends of oxygen sensors for the respective cylinder banks being smaller than a dimension between outer ends of said catalytic converters.

15. A multi cylinder internal combustion engine according to claim 11, wherein said exhaust system component consists of a catalytic converter, and an outer profile of said oxygen sensor is more inwardly located than an outer profile of said catalytic converter.

* * * * *